US006449218B1

(12) United States Patent
Lluch

(10) Patent No.: US 6,449,218 B1
(45) Date of Patent: Sep. 10, 2002

(54) MEDICINE STORAGE AND REMINDER DEVICE

(76) Inventor: Alex Lluch, 6247 Caminito Tenedor, San Diego, CA (US) 92129

( * ) Notice: Subject to any disclaimer, the term of this patent is extended or adjusted under 35 U.S.C. 154(b) by 0 days.

(21) Appl. No.: 09/640,057

(22) Filed: Aug. 17, 2000

Related U.S. Application Data

(63) Continuation-in-part of application No. 09/169,099, filed on Oct. 9, 1998

(60) Provisional application No. 60/061,512, filed on Oct. 10, 1997.

(51) Int. Cl.[7] ..... G04B 47/00; G04B 37/00

(52) U.S. Cl. ..... 368/10; 368/69; 368/276; 221/3; 225/43

(58) Field of Search ..... 368/10, 107–109; D24/23; 30/124; 225/43; 206/538

(56) References Cited

U.S. PATENT DOCUMENTS

| | | | | | |
|---|---|---|---|---|---|
| 2,655,259 | A | * | 10/1953 | Davoren | 225/43 |
| 3,762,601 | A | * | 10/1973 | McLaughlin | 368/10 |
| 4,159,568 | A | * | 7/1979 | Berner | 30/124 |
| 4,258,354 | A | * | 3/1981 | Carmon et al. | 368/10 |
| 4,293,845 | A | * | 10/1981 | Villa-Real | 368/10 |
| 4,483,626 | A | * | 11/1984 | Noble | 368/10 |
| 4,490,711 | A | * | 12/1984 | Johnston | 368/10 |
| 4,626,105 | A | * | 12/1986 | Miller | 368/10 |
| 4,725,999 | A | * | 2/1988 | Tate | 368/10 |
| D310,731 | S | * | 9/1990 | Lieptz | D24/23 |
| 4,962,491 | A | * | 10/1990 | Schaeffer | 368/10 |
| 5,020,037 | A | * | 5/1991 | Raven | 368/10 |
| 5,099,463 | A | * | 3/1992 | Lloyd et al. | 368/10 |
| 5,200,891 | A | * | 4/1993 | Kehr et al. | 368/10 |
| 5,289,157 | A | * | 2/1994 | Rudick et al. | 368/10 |
| 5,332,114 | A | * | 7/1994 | Sano et al. | 220/505 |
| 5,408,443 | A | * | 4/1995 | Weinberger | 368/10 |
| 5,646,912 | A | * | 7/1997 | Cousin | 368/10 |
| 5,915,558 | A | * | 6/1999 | Girvetz | 368/10 |
| 6,169,707 | B1 | * | 2/2001 | Newland | 368/10 |

* cited by examiner

*Primary Examiner*—Vit Miska
*Assistant Examiner*—Jeanne-Marguerite Goodwin
(74) *Attorney, Agent, or Firm*—Donn K. Harms

(57) ABSTRACT

An electronic device for holding medicines, typically pills, to be taken at different times and to remind the user to take particular pills at specific times. A first container has a plurality of pill holding compartments, with a hinged lid closing each compartment. A second container, which is releasably fastenable to the first compartment, contains a microprocessor, an alarm, a display and buttons for controlling the microprocessor to display different information. The display can be set to show the time, times for taking pills from different compartments, whether pills have been taken on time, if a pill has been missed or skipped, when the last pill has been taken, etc. When a time set for taking a pill arrives, an alarm, typically a light and/or sound alarm, alerts the user as to the compartment holding the pill to be taken. A pill splitter is further provided that can be releasably fastened to one of the compartments and provides quick, accurate and safe splitting of pills so that halves may be placed in the compartments to be taken as indicated by the alarm system.

8 Claims, 2 Drawing Sheets

MEDICINE STORAGE AND REMINDER DEVICE

CROSS-REFERENCE TO RELATED APPLICATION

This application is a Continuation-in-Part of application Ser. No. 09/169,099 filed Oct. 9, 1998, which is a Continuation in Part of Application Ser. No. 60/061,512, filed Oct. 10, 1997.

FIELD OF THE INVENTION

The present invention relates generally to timing devices for scheduling an event, and prompting a person to respond to the event. More particularly, though not exclusively, the present invention relates to a timing device having an attachable pill box and having a series of timers and alarms to be used for scheduling and reminding a person to take his or her medicine.

BACKGROUND OF THE INVENTION

Over the years, an entire family of pill boxes have been developed in order to assist people in remembering to take their medicine. For instance, small, pocketsized pill boxes have been around for generations and allow a person to fill their pill box with the medicine for the day and conveniently carry it with them. While these traditional pill boxes facilitate the transportation of medicines, a problem often arose when the person was required to take more than one kind of medicine during the day. In such circumstances, the person often may not be able to distinguish the different medicines, and thus, may take the medicine in incorrect dosages or at the wrong time intervals.

In response to this problem, a number of pill boxes were created which had different compartments for holding different medicines. Thus, at the time to take medicine, a person would only have to select the pills from the appropriate compartment. While this tended to minimize the level of confusion associated with taking different medicines, it did little to assist the person to remember when to take their medicine.

As technology has evolved over the last few decades, a large number of solutions have been tried in an effort to assist people with the painful task of remembering to take their medicine. One such solution was to create a pill box having an integral count-down timer. Using this device, a person could place his or her medicine within the pill box and set the count-down timer for a specific time interval, such as four (4) hours. Then, four (4) hours later, the count-down timer will sound and the person will be alerted to take the medicine. While this device provided an effective means to alert a person at the time to take the medicine, it provides no assistance to people having to take more than one medicine at different time intervals. In fact, since the count-down timer only accommodates a single time interval, it is useless for combinations of medicines having different administration times unless the user resets the count-down timer over and over again.

To overcome the multiple administration time problems associated with count-down timers, timers were developed having more than one count-down timer interval. Using these devices, a person could set a first count-down timer for four (4) hours, and a second count-down timer for eight (8) hours. When the first count-down timer sounded, the person could take his or her first dose of medicine, and when the second count-down timer sounded, the person could take his or her second dose of medicine. In circumstances where the pill box included more than one compartment, each of the timers could be associated with one or more of the compartments, and thus when the first timer sounds, medicine in one compartment may be taken, and when the second timer sounds, medicine in the other compartment may be taken.

While the pill boxes with count-down timers assisted the medicine-takers in remembering their medicine, these devices were ineffective in situations where the count-down timers would sound when the person was unable to take the medicine, such as during a meeting. However, since the person would need to quiet the timer immediately, the timer would be disabled, and then the person would once again have to rely on his or her memory to take the medicine following the meeting, for example.

In circumstances where the medicine cannot be taken when the timer sounds, a person's entire medicine schedule may become delayed. In addition, many existing devices do not monitor whether the medicine was taken, or at what time the medicine was taken.

Although some pill boxes with timers may assist people in remembering to take their medicine, unfortunately most of these devices must be re-programmed on a daily basis. This re-programming introduces the opportunity to make errors, and may be too difficult for the elderly.

Even if the pill box has the ability to remember a schedule of medicine from day to day, the person is still required to re-load the pill box compartments with the medicine for the day, and may result in the person not using the pill box, or making errors in the constant refilling of the compartments.

In light of the above, it would be advantageous to provide a pill box having a scheduling device capable of notifying a person when to take his or her medicine. It would also be advantageous to provide a pill box capable of tracking whether or not the person has in fact taken his or her medicine after the notification. Also, it would be advantageous to provide a pill box having the ability to notify and track more than one medicine administration, including medicines having different dosages and administration intervals.

It would also be advantageous to provide a pill box having a detachable timer device such that a number of pill boxes may be loaded with medicine at the same time. Thus, at the beginning of the week, the detachable timer device may be moved from pill box to pill box so that the person does not have to refill the pill box each day, thereby minimizing the likelihood of error in selecting the medicine, or in remembering to refill the box. This feature would be particularly advantageous for the elderly as they would no longer be responsible for selecting their medicine on a daily basis, but would be able to have an assistant load their pill boxes for the entire week at one time. Further, there is a need for information providing the time the last medicine was taken and whether a dose was missed or skipped.

SUMMARY OF THE INVENTION

The above noted problems, and others, are overcome by this invention, which comprises a box having multiple medicine compartments, each of which typically holds one or more pills, capsules or the like and a timing device capable of scheduling medicine administration, monitoring whether an administration schedule is followed, and alerting the user of an appropriate scheduled administration event.

The pill box of the present invention includes a number of medicine compartments. A pill splitter may be fastened to the pill box to permit pills to be divided as necessary. Each of the medicine compartments is equipped with a hinged, releasable, lid so that medicine may be placed in the compartment, the lid closed and the box safely transported. A latch for releasably locking the lid in the closed position is also included.

The timing device of the device includes a microprocessor programmed to facilitate the scheduling and administration of medicine. Specifically, the timing device is equipped with a number of timers and/or alarms, with each such timer and/or alarm corresponding to a single medicine compartment in the storage box. In this manner, when the timer and/or alarm corresponding to a particular medicine compartment is activated, the person can identify the appropriate time and dosage for that medicine. The alarm preferably has a volume control, so that the alarm can be made quite loud for use by those with impaired hearing. Each compartment may be filled once a week, once daily or whenever the compartment becomes empty, as desired.

Due to the detachable nature of the medicine storage box, the box may be separated from the timing device for individual use, or for periodically changing boxes, such as providing a different box for each day of the week, where numerous different medicines must be taken at different times each day. Also, in the event a large amount of medicine is consumed daily, a first storage box may be loaded with a morning supply of medicine and another box filled with the afternoon supply of medicine.

An important advantage of the present invention is the ability to associate the timer device with any number of storage boxes. Consequently, it is no longer necessary to reload a pill box every day, but rather the entire week's worth of medicine may be placed in series of seven different boxes. Each box may then be secured to the timing device in seriatim each day to provide the medicine for that day. Moreover, a care giver may preload this medicine for an elderly person, thereby eliminating the need for the person to organize his or her own medicine administration. Also, if desired the user can leave the medicine in the original bottle and the alarm number can be written on the bottle.

A wide variety of information is provided by the timer and alarm box. For example, in addition of alerting the user to times at which medicine should be taken, the timer box will inform the user when the last dose of each medicine was taken and how many doses have been missed or intentionally skipped. The display will tell the user when the next dose of each medicine is scheduled to be taken. If the user has not taken the medicine when an alarm has sounded, at a later time the user can look at the "next" indication and decide if it is safe to take a late dose or to wait for the next alarm for that medicine.

BRIEF DESCRIPTION OF THE DRAWINGS

The nature, objects, and advantages of the invention will become more apparent to those skilled in the art after considering the following detailed description in connection with the accompanying drawings, in which like reference numerals designate like parts throughout, and wherein.

DETAILED DESCRIPTION OF PREFERRED EMBODIMENTS

Figure 1:
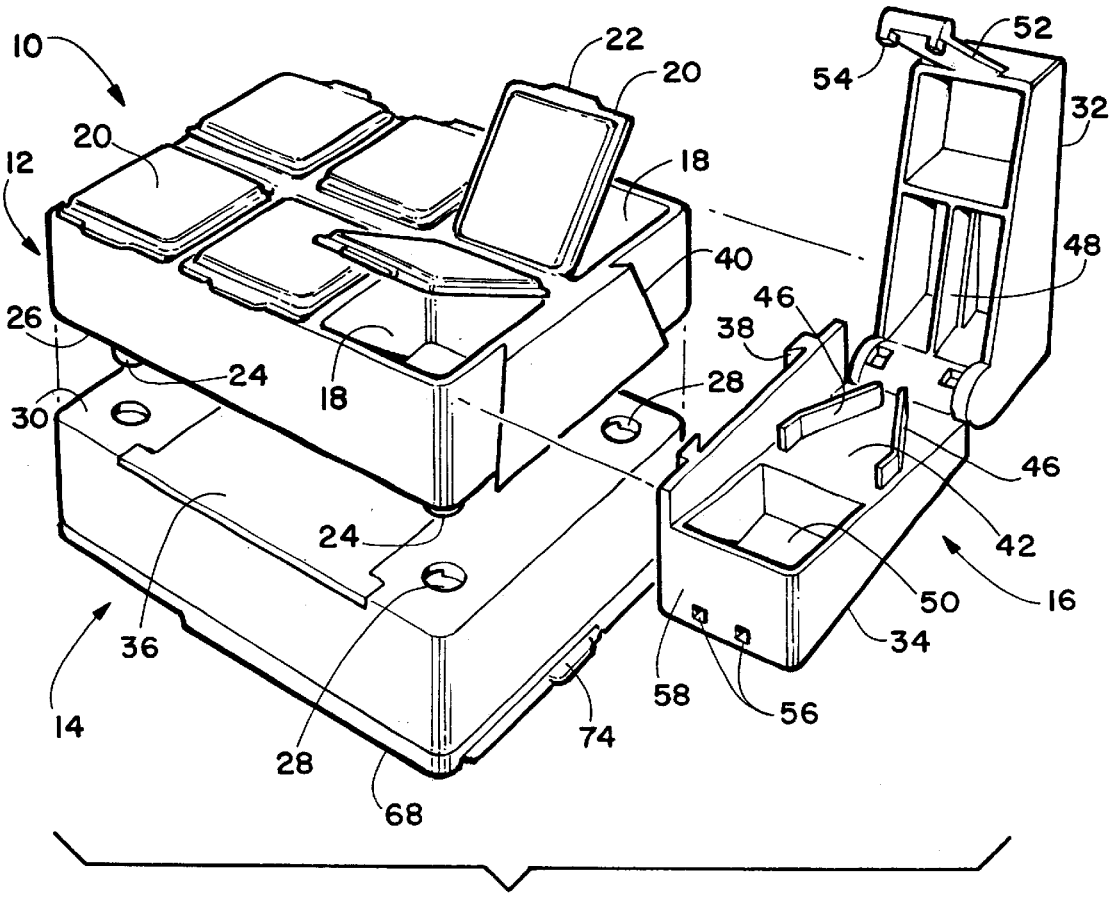
FIG. 1 is an exploded perspective view of the pill box, timer and alarm box and optional pill splitter.

FIG. 1 illustrates in exploded perspective form the medicine storage and reminder system 10. System 10 basically includes a container 12 for dry medicines such as pills, capsules, etc., a timer and alarm container 14 and an optional pill splitter 16.

Medicine storage box 12 basically comprises a plurality of cavities 18 for receiving pills and the like, with a corresponding plurality of hinged lids 20. Each lid includes an edge 22 which, in a conventional manner, snaps over the corresponding edge of each cavity 18 to releasably hold the lid in the closed position. Any other suitable releasable lid closure means may be used as desired. Any suitable number of cavities and lids may be used. The upper surfaces of lids 20 may bear any suitable indicia such serial numbers, times of day at which medicine is to be taken, days of the week, etc. The lids may be permantly marked or may have a surface suitable for marking with an erasable felt tip marker, a pencil, etc.

Container 12 is releasably secured to timer and alarm container 14 with any suitable releasable fastening means. In the preferred embodiment shown, a plurality of pegs 24 are provided on the back surface 26 of container 12 and a plurality of corresponding holes 28 are provided in the back surface 30 of timer and alarm container 14. Preferably, four sets of pegs and holes are provided, adjacent to corners of the containers, are preferred. Typically, pegs 24 have enlarged heads that snap into holes 28 in a conventional manner. While any other releasable connection means may be used between container 12 and container 14, such as hook-and-loop material of the sort available under the Velcro® trademark could be used if desired, the peg and hole arrangement as shown is preferred as providing a particularly effective connection while allowing separation when necessary. A removable cover 36 on back 30 closes a battery compartment in alarm and timer container 14.

Where at least some conventional compressed pills are to be contained, in many cases a person is required to split the pills and take the halves at different times. Under those circumstances, pill splitter 16 is preferably included. Pill splitter 16 includes a base 34 and a hinged lid 32 movable between an open position as shown to provide access to the interior of base 34 and a closed position covering the base. While any suitable means may be used to releasably secure pill splitter 16 to container 12, the cooperating tapered slot 38 and wedge 40 arrangement as shown is preferred. Slot 38 conforms to the shape and size of wedge 40 and can be slipped sownwardly over the wedge to be held in place thereon. The shape of the wedge interface prevents pill splitter 16 moving further downwardly, while friction will prevent removal of the pill splitter without significant upward force on the pill splitter.

Pill splitter 16 base 34 includes a shelf 42 having two adjacent upwardly extending walls 46 which are spaced apart in a funnel-like arrngement. A sharp blade 48 is mounted in lid 32 so as to be brought into the space between walls 46 when the lid is closed. Thus, a pill placed between walls 46, where the space between walls is narrow, will be split by blade 48 when lid 32 is closed. A cavity 50 is provided in base 34 adjacent to the wide end of the funnel formed by walls 46. After a pill is split, the halves can be moved by a finger tip into cavity 50. Then additional pills may be split and one half placed in each of cavities 18 in pill container 12.

A latch mechanism is provided to securely, but easily releasable, hold lid 32 in the closed position while the assembly 10 is carried in a pocket, purse or the like, to prevent inadvertent contact of a finger or other object with blade 48. The latch mechanism includes a hinged flap 52 mounted on lid 32 having two upstanding end pegs 54. Two holes 56 are provided in base and positioned so that when lid 32 is closed and flap 52 is moved toward front wall pegs 54 will enter holes 56 and be frictionally locked therein. No outside forces, such as an attmept to raise lid 32 or a bump against the lid will act to unlock flap 52. To open the flap requires that a fingernail or the like be inserted under the free end of flap 52 and the flap be pulled outwardly. This opening step can only be taken deliberatly, so that inadvertent opening is prevented.

Figure 2:
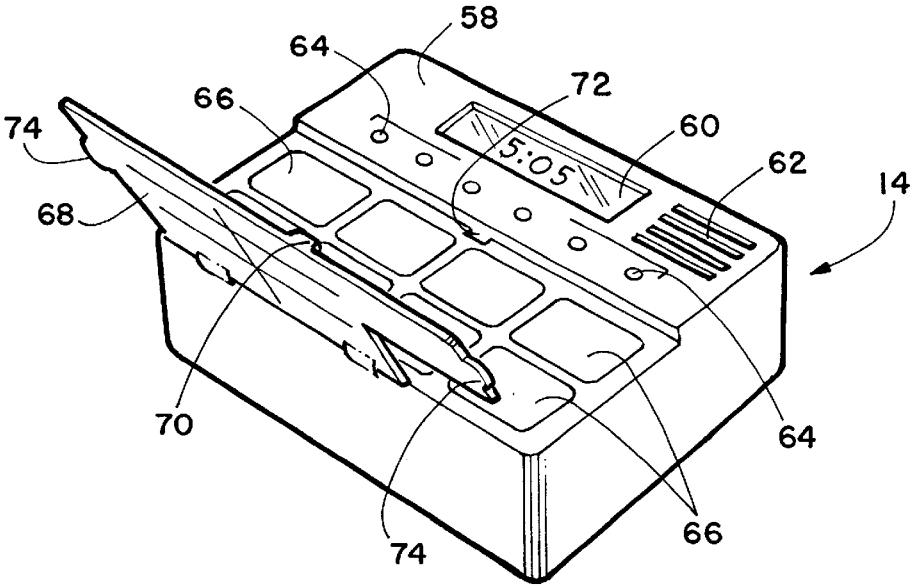
FIG. 2 is a perspective view of the operating face of the time and alarm box.

FIG. 2 shows the operating face of timer and alarm container 14. Container 14 contains conventional batteries, a speaker and a conventional microprocessor (not shown) for operating the system shown in block diagram in FIG. 8. Any suitable microprocessor may be used. A preferred microprocessor is the KS57C2504 microcontroller available from the Samsung Electronics company. The microprocessor is programmed in a conventional manner to perform the operations described below.

Face 58 of container 14 includes a liquid crystal display 60 which normally displays the time on a twelve-hour basis, plus an AM/PM indication. A "broken battery" symbol 61 will appear when the battery is depleted and only a few weeks of service remain. Display 60 will also display information ast when each alarm's last dose was taken, the "next" programmed time, the number of doses taken, missed and intentionally skipped and when a time is a "scheduled" time. Openings 62, typically slots or small spaced round openings are provided for emission of sound from the conventional internal speaker (not shown). A series of light emitting diodes is provided, corresponding in number to the number of capsules 18 provided in pill container 12. Indicia, typically numbers or other markings corresponding to markings on lids 20 are preferably provided adjacent to LED's 64

A series of switch buttons 66 is provided for operation of the system. The multiple functions of these buttons 66 will be explained in the description of system operation, below, in conjunction with the showing in FIG. 3.

Figure 3:
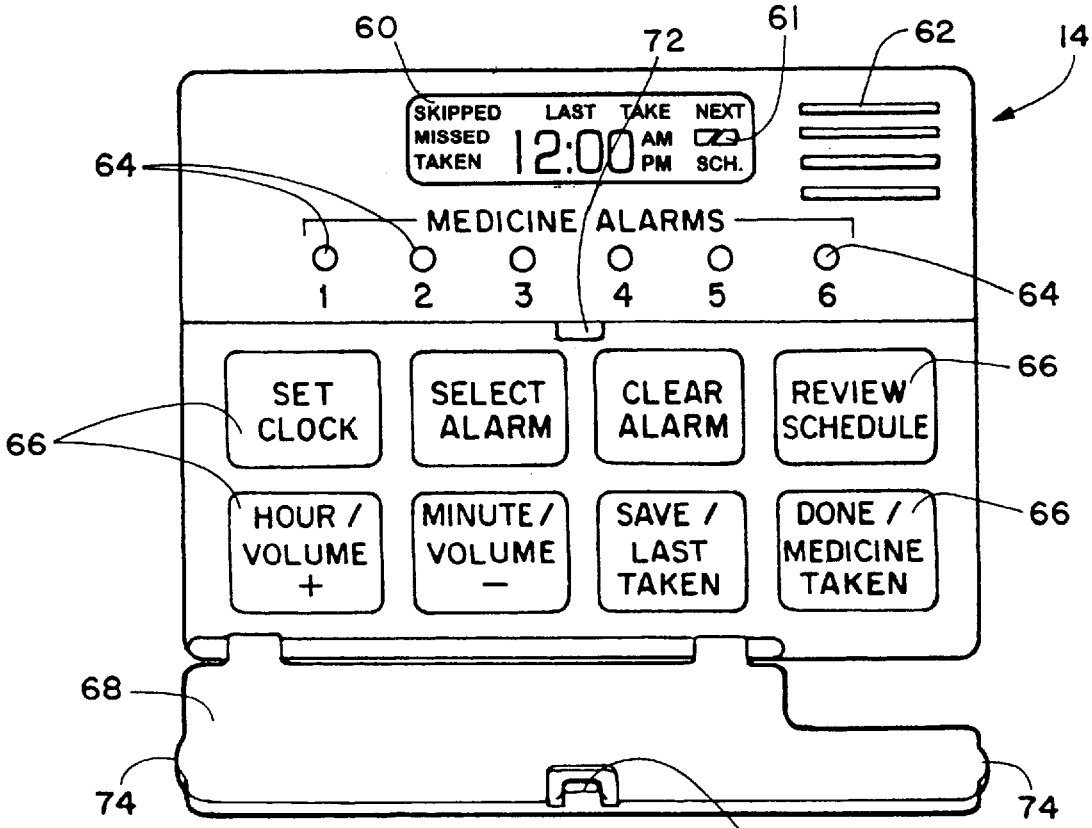
FIG. 3 is a plan view of the timer and alarm box showing switch button indicia.

A hinged lid 68 is movable between an open position giving access to all button switches 66 and a closed position covering all but the button labeled "medicine taken" to protect the covered button switches. Latch tab 70 on lid 68 snaps over edge 72 on surface 58 of container 14 to releasably hold the lid closed, as best seen in FIG. 3. Tabs 74 (as best seen in FIG. 1) extend from lid 68 for engagement by fingers to open the lid. Pill container 12 and timer and alarm container 14 are preferably formed from a tough, flexible plastic such as acrylonitrile-butadiene-styrene (ABS).

FIG. 3 shows the timer and alarm container 14 in plan view, with preferred labels on the switch buttons 66 indicating functions in the different operational modes. Light emitting diodes have adjacent numbers corresponding to the cavities 18 as seen in FIG. 1.

Figure 4:
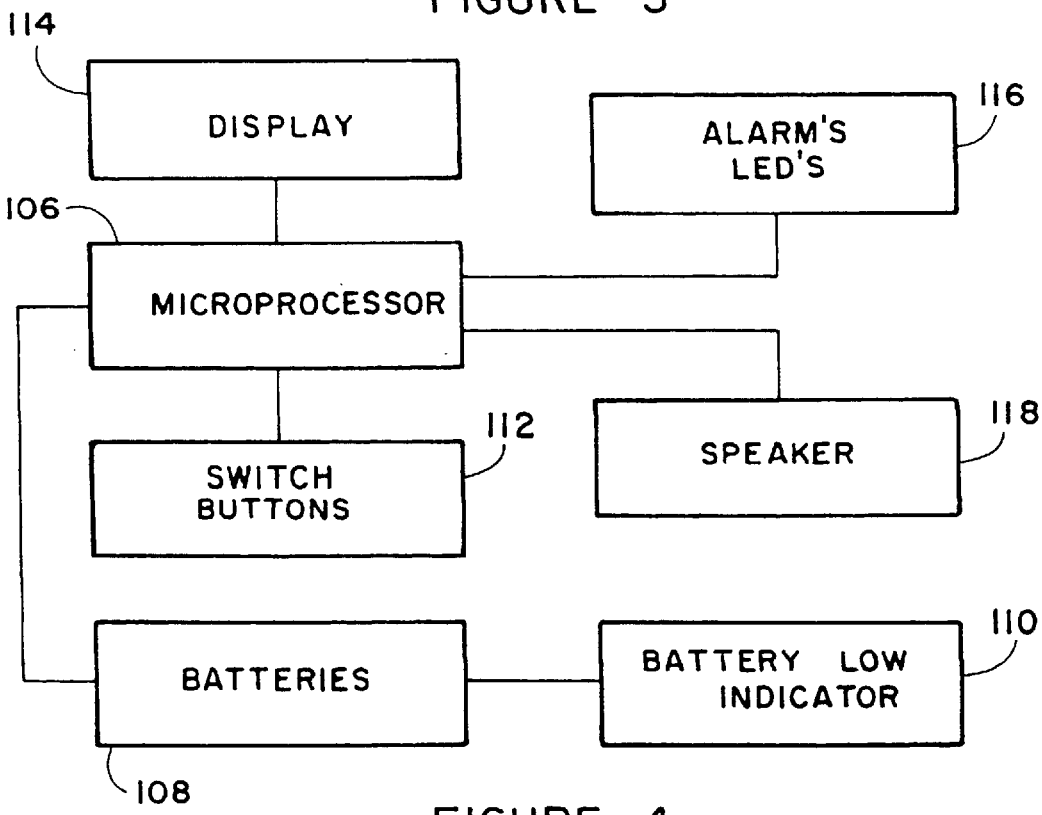
FIG. 4 is a schematic block diagram of the componenst of the timing and alarm mechanism.

The arrangement of the electronic components is schematically illustrated in the block diagram of FIG. 4. Microprocessor 106, typically the KS57C2504 microcontroller mentioned above is powered by a battery pack 108, typically two 1.5 volt AA batteries. A battery low indicator 110 warns that the batteries will run out shortly. Typically, indicia 61 is displayed on display 60 (as seen in FIG. 3) when batteries are low.

Microprocessor 106 is controlled by button switches as indicated in block 112. Typically these are conventional pressure sensitive switches as shown at 66 in FIG. 3. Microprocessor 106 drives a display 114, typically a liquid crystal display 60 as seen in FIG. 3, and alarms such as lights 116 and speaker 118. Replaceable pressure sensitive labels may be provided on the lid 68 so that information about the pills contained in each compartment can be written thereon. Or, the surface may be such that the information can be written directly on the lid in pencil or erasable pen and erased and rewritten as needed.

General System Operation

Device 10 may be operated in any suitable manner. Preferably, three operating modes are provided, generally termed the "normal mode", the "program mode" and the "alarm mode". There are three main modes in the Easy Minder: Normal Mode, Program Mode and Alarm Mode. During Normal Mode the device is simply showing the time of day. During Program Mode the device is ready to accept programming data from the user. In this mode the display and/or one of the LED's will flash indicating that it is in program mode. During Alarm Mode the device will indicate the scheduled time and the next scheduled time for each alarm that has gone off. The alarm will beep to alert the user that a scheduled time has arrived. The LED's will blink indicating which alarm(s) is active.

The functions of all the buttons of the Medicine Reminder in all the three modes ar as follows:

The following are brief descriptions of the various modes of the Medicine Dispenser With Detachable Timing Device of the present invention.

Normal Mode

SET CLOCK

To set the time of day

SELECT ALARM

To choose one of the six alarms and put the device in Program mode

CLEAR ALARM

No function

REVIEW SCHEDULE

To show the schedule programmed for all of the alarms

HOUR/VOLUME+

To increase the speaker volume

MINUTE/VOLUME

To decrease the speaker volume

SAVE/LAST TAKEN

To request the device to display the time last taken of all the programmed alarms

DONE/MEDICINE TAKEN

No function

Program Mode

SET CLOCK

To find out how many medicines the user has taken, has forgotten to take, and has intentionally skipped of a particular alarm.

SELECT ALARM

To move to the next alarm

CLEAR ALARM

To clear all previously programmed time for the selected alarm

REVIEW SCHEDULE

To review all previously programmed time for the selected alarm

HOUR/VOLUME+

To increase the Hour in the display

MINUTE/VOLUME

To increase the Minute in the display

SAVE/LAST TAKEN

To save in memory the last entry

DONE/Medicine TAKEN

To get out of program mode

Alarm Mode

SET CLOCK

No function

SELECT ALARM

No function

CLEAR ALARM

When the user hits this button in Alarm mode, the device will stop displaying the scheduled time and the next scheduled time for the lowest numbered (ex. Alarm #1) active alarm. The device will increment the counter to total the number of medicines the user has intentionally not taken for that alarm. The device will stop that alarm from beeping.

The device will continue showing the times for the remaining alarms that are going off, if any. Therefore, the user must hit either Clear Alarm or Done/Medicine Taken once for each alarm that is going off.

REVIEW SCHEDULE

No function

HOUR/VOLUME+

To increase the alarm volume

MINUTE/VOLUME

To decrease the alarm volume

SAVE/LAST TAKEN

To request the device to display the time last taken of all the programmed alarms that are going off and then return to display the scheduled time and the next scheduled time of all the alarms that are going off.

DONE/Medicine TAKEN

To tell the device that the user has taken that medicine. When the user presses this button in Alarm mode, the device will stop displaying the scheduled time and the next scheduled time for the lowest numbered (ex. Alarm #1) active alarm. The device will increment the counter to total the number of medicines taken for that alarm. The device will stop that alarm from beeping. The device will continue showing the times for the remaining alarms that are going off. Therefore, the user must hit either Clear Alarm or Done/Medicine Taken once for each alarm that is going off.

Operation of a Preferred Embodiment

1. Normal Operation:

The display normally shows the time of day (12 hour display with AM/PM indicator) until a scheduled time for an alarm is reached.

2. When the device reaches a scheduled time for an alarm:

a) The alarm will beep for 0.5 second every two seconds over a 30-second period. After the first 30 seconds, every several minutes (typically five minutes), the alarm will beep for 0.5 second, typically every two seconds over a ten second period until, the Done/Medicine Taken button or Clear Alarm button is pressed.

b) The LED corresponding to that alarm will quickly flash. The display alternates between showing the scheduled time for about two seconds together with the word "TAKE" and then display the next scheduled time for another two seconds with the word "NEXT". The device will perform these operations consecutively until the Done/Medicine Taken or Clear Alarm button is pressed.

3. When the device reaches another scheduled time for the same alarm before the user presses the Done/Medicine Taken or Clear Alarm button for the previously programmed time:

a) The device deletes the previously scheduled time and perform the same operations as in section 2 with the new scheduled time. Therefore, the display flashes the new scheduled time as well as the next scheduled time.

b) When this occurs, the device counts and stores this incidence of a missed medicine (or "non-compliance").

4. When the device reaches a scheduled time for an alarm while displaying the scheduled time for another alarm(s) not yet acknowledged by the user:

a) The alarm will beep for 0.5 second every two seconds over a 30-second period. After the first 30 seconds, every five minutes, the alarm beeps for 0.5 second every two seconds over a ten second period until the Done/Medicine Taken or Clear Alarm button is pressed. One of these two buttons must be pressed for each alarm that is going off.

b) The device performs the following operations consecutively until the Done/Medicine Taken or Clear Alarm button is pressed. One of these two buttons must be pressed for each alarm that is going off.

The LED corresponding to the first alarm quickly flashes and display shows the scheduled time for about two seconds and then flashes the next scheduled time for about two seconds. The LED for that alarm then goes off. The LED of the next alarm will then quickly flash for two seconds. During these this time, the display flashes the scheduled time for about two seconds and then shows the next scheduled time for about two seconds.

c) The device performs this cycle of operations for each of the alarms that has reached its scheduled time until the Done/Medicine Taken or ClearAlarm button is pressed. One of these two buttons must be pressed for each alarm that is going off.

d) Then the device goes back to step 2*b*.

e) The user must hit the Done/Medicine Taken or Clear Alarm button once for each alarm that is active. The device will then erase each active alarm in chronological order. For example, if three different alarms are active (Alarm #1, #3, and #5), the user hits Done/Medicine Taken or ClearAlarm once and the device will turn off Alarm #1. The user will then need to hit Done/Medicine Taken or Clear again to then turn off Alarm #3.

The user will then press Done/Medicine or ClearAlarm again to turn off Alarm #5. The device will deactivate the alarms in sequential order (#1 through #6) regardless of which alarm became active first. The device will then display the time of day until another scheduled time is reached.

5. When a scheduled medicine is an elective medicine and it is up to the patient if he or she feels it necessary to take it at the programmed time, the user will have two options. If the user decides to take the medicine at that time, the user presses Done/Medicine Taken. The device will increment the counter that keeps track of the number of times the user chooses to take this alarm's medicine. If the user decides not to take the medicine, the user presses Clear Alarm. The device will increment the counter that keeps track of the number of times the user chooses not to take this alarm's medicine.

6. When the unit is in any of the program modes, the device will return to normal mode if the user does not hit any button within 60 seconds.

Programming the Medicine Reminder

At the press of any key, the device will produce a distinguishable beep sound indicating that a key has been pressed.

To Program Time of Day

1. Press Set Clock. The Clock Display will flash, indicating the device is in program mode.

2. Press the Hour/Volume+ and Minute/Volume,– buttons until the correct time of day shows on the display.

3. Press Save/Last Taken.

4. Press Done/Medicine Taken. The Clock Display will display current time of day.

To Program One Alarm

1. Continue pressing Select Alarm until the LED of the alarm to be programmed quickly flashes. The clock display will slowly flash, indicating the device is in Program mode. If there is nothing programmed for this alarm, the clock display will flash (0:00, OFF or Blank.) If there is a time programmed for this alarm, the display will flash the first time of day for which that alarm has been previously programmed.

2. If the display shows (0:00, OFF or Blank), perform steps 2.1 to 2.3. Otherwise perform steps 3.1 to 3.5. Simply press Hour/Volume+ or Minute/Volume– buttons until the first required schedule time shows on the display.

2.2 Then press Save/Last Taken. Continue repeating steps2.1 to 2.2 until all times for that alarm have been entered.

2.3 Press Done/Medicine Taken. The LED corresponding to the alarm being programmed and the clock display will stop flashing. The display clock will return to time of day.

3. If the clock display shows any time, perform steps 3.1 to 3.5.

3.1 Press Clear Alarm to erase all previously programmed times for this alarm. The display will show 0:00, OFF or be blank.

3.2 Press the Hour/Volume+, and Minute/Volume– buttons until the required schedule time shows on the display.

3.3 Then press Save/Last Taken.

3.4 Continue steps 3.2 and 3.3 until all times for that alarm have been entered.

3.5 Press Done/Medicine Taken. The LED corresponding to the alarm being programmed and the clock display will stop flashing. The display clock returns to the time of day.

4. If Done/Medicine Taken is not pressed after 60 seconds, the device goes back to normal operation.

5. To correct a mistake while programming, press Done before pressing Save. Entries programmed are not saved until Save is pressed.

To Review Alarm Program

There are two options to review the times for which each alarm has been programmed:

Option 1

In Normal mode, press the Review Schedule button. The device will light LED # 1 and show all the times programmed for that medicine for about two seconds each. Also, "SCH" will appear on the display indicating that these are scheduled times. The device will then perform this function for all the alarms which have been programmed previously. The device will continue scrolling all the times for which each of the alarms have been programmed until each alarm's schedule is displayed a total of three times. If Done/Medicine Taken is pressed during the time the display is displaying the schedules, the device goes back to normal operation.

Option 2

In Program mode, press Select Alarm until the LED of the alarm corresponding to the alarm that the user wants to review goes on. The display will flash the first programmed time and display "SCH". Press Review Schedule. The device will show all the times programmed for that alarm. The display will flash each programmed time for about two seconds. The display will continue scrolling through all scheduled times until each alarm's schedule is displayed a total of three times. If Done/Medicine Taken is pressed, during the time the display is displaying the schedules the device goes back to normal operation.

To Clear an Alarm Completely

1. Press Select Alarm until the LED of the alarm corresponding to the alarm that the user wants to clear goes On. The LED corresponding to that alarm and the clock display will flash the first programmed time indicating the device is in Program mode.

2. Press Clear Alarm. The display will flash (0:00, OFF or Blank) indicating there are no programmed times for that alarm and that the unit is ready to be programmed. This operation completely clears all the times for which that alarm has been programmed and will not beep any longer until the user re-programs that alarm. The "missed", "taken" and "skipped" compliance counters for that alarm are also cleared and reset to "0".

3. Press Save/Last Taken. If Save/Last Taken is not pressed, the alarm will restore to the previous settings when Done/Medicine Taken is pressed.

4. Repeat steps 1 through 3 until all the alarms the user wants to clear have been cleared.

5. Press the Done/Medicine Taken. If Done/Medicine Taken is not pressed, after 60 seconds the device will go back to normal operation.

To Clear a Scheduled Time That has Been Programmed on One Alarm

1. Press the Select Alarm button until the LED corresponding to the alarm which the user wants to turn off time flashes. The display will flash the first programmed time.

2. If the time the user wants to delete shows on the display, perform step 3; if not, perform steps 4 and 5.

3. Simply press the Hour/Volume,+ button until the display shows (0:00, OFF or Blank).

4. Continue pressing Save/Last Taken until the schedule time to be turned off shows on the display.

5. Simply press the Hour/Volume+ button until the display shows (0:00, OFF or Blank). Then press Save/Last Taken again. If the user does not press Save/Last Taken, the alarm schedule will remain unchanged.

6. If the user wants to delete other previously programmed times, the user simply repeats steps 4 and 5 until all the preprogrammed times to be turned off have been turned off.

7. When done press the Done/Medicine Taken button. If Done/Medicine Taken is not pressed after 60 seconds, the device will go back to normal operation.

To Change a Scheduled Time That has Been Programmed on One Alarm

1. Press the select Alarm button until the LED corresponding to the Alarm in which you want to make a change lights up.

2. If the time you want to change shows on the display, perform step 3; if not, perform steps 4 and 5.

3. Simply press the Hour/Volume+ button until the display shows the new required time in hours. Then press the Minute/Volume+ or – button until the display shows the new required time in minutes.

4. Continue pressing Save/Last Taken until the schedule time you want to change shows on the display.

5. Simply press the Hour/Volume+ or = button until the display shows the new required time in hours. Then press the Minute/Volume+ or – button until the display shows the new required time in minutes.

6. If the user wants to change a previously programmed time, the user simply repeats steps 4 and 5 until all preprogrammed times to be changed have been changed.

7. When done, press the Done/Medicine Taken button. If Done/Medicine Taken is not pressed, after 60 seconds the device will go back to normal operation.

To Adjust the Alarm Volume

1. Whenever the device is not in program mode (Set Clock, Select Alarm or Review Program buttons have not been pressed, the Hour/Volume+ and Minute/Volume− buttons will serve as volume controls for the alarm. Whenever the Hour button is pressed in non-programming mode, the alarm will beep, indicating the new higher volume.

2. Whenever the Minute/Volume− button is pressed in non-programming mode, the alarm will beep, indicating the new lower volume.

3. The alarm preferably has six different volume levels.

To Review the Record of Medicine Doses Taken

This includes doses the user has not taken, forgotten to take and/or intentionally did not take for each medicine.

1. In Normal mode, continue pressing Select Alarm until the LED of the alarm corresponding to the medicine that the user wants to review flashes.

2. Press Set Clock once. The display will show the number of doses of this medicine taken by displaying "TAKEN" and how many doses of this medicine the user has taken since the last time the unit was cleared. The display will show this information for about two seconds, then the display will show the number of dosed of this medicine has forgotten to take by displaying "MISSED" and how many doses of this medicine the user missed since the last time the unit was cleared. The display will show this information for about two seconds. Then the display will show the number of doses the user intentionally did not take by displaying "SKIPPED" and the number of doses the user skipped or did not take. The display will show this information for about two seconds.

3. Press Clear Alarm while this information is being displayed to erase/reset counter. The information in all three counters will be reset. Then press Save/Last Taken. If the user does not press Save/Last Taken, then the counter and the programmed schedule will not be reset.

4. If no button is pressed, after the display shows the entire sequence of "TAKEN", "MISSED" and "SKIPPED" for a total of three times the device will return to the normal mode.

To Review the Last Time a Specific Medicine was Taken

There are three options to review last time the user took each medicine.

Option 1

In Normal mode, press the Save/Last Taken button. The device will light LED # 1 and show "LAST" for two seconds the last time medicine # 1 was taken. The device will then perform this function for all the alarms which have been programmed. The device will continue scrolling all the times of the last medicine taken until the user presses Done/Medicine Taken. If Done/Medicine Taken is not pressed, the device goes back to normal operation after the display shows the sequence for a total of three times.

Option 2

In Program mode, continue pressing Select Alarm until the LED corresponding to the medicine flashes. The display will flash the first programmed time for that alarm. Press Save/Last Taken. The device will show the last time that medicine was taken. The display will continue showing the last time the user took that medicine until the user presses Done/Medicine Taken to return to Normal mode. If Done/Medicine Taken is not pressed, after 30 seconds the device goes back to normal operation.

Option 3

In Alarm mode, if the alarm has reached a programmed time and is flashing the current programmed time and the next programmed time, press Save/Last Taken to view the last time medicine was taken for that alarm. The device will display the last time that medicine was taken for three seconds and the alarm's corresponding LED will flash, and then return to the previous mode to show the scheduled time and the next scheduled time of the alarm.

If there is more that one alarm going off at the same time the display will show for three seconds the last time the medicine was taken for each alarm while also flashing the corresponding LED.

Where it is desired that a pill be split in two to reduce the dose by half, pill splitter 16 is opened, the pill is placed between walls 46 at the narrow end and the cover is closed, causing blade 48 to safely divide the pill. The two halves can be pushed into cavity 50 and additional pills split.

Other variations, applications and ramifications of the invention will be understood upon reading this disclosure. Those are intended to be included within the scope of this invention, as defined in the appended claims.

I claim:

1. A unitary, user operable, electronic medicine storage and reminder device, which comprises:

first and second containers;

means for releasably securing said first and second containers together;

said first container comprising:

a plurality of spaced compartments;

a lid for each said compartment; and latch means for releasably closing each said compartment;

said second container comprising:

an alarm signaling means comprising a light emitting means corresponding to each of said compartments and a sound emitting means;

display means for displaying indicia;

a microprocessor including:

a plurality of manual means to program said microprocessor including:

a first manual user operable means for setting correct time and for displaying said correct time on said display means;

a second manual user operable means for setting alarm times for taking medicine from each said compartment, for displaying alarm times on said display means and for actuating said signaling means at said alarm times;

a third manual user operable means for clearing all set alarm times;

a fourth manual user operable means for displaying all set alarm times in seriatim;

a plurality of user operable switch buttons including:

user operable switch button means for displaying indicia on said display indicating that a time for taking a medicine has arrived and the time for taking the next medicine;

user operable switch button means for displaying indicia on said display indicating that a medicine has been taken when scheduled;

user operable switch button means for displaying indicia on said display indicating that a medicine has not been taken when scheduled;

user operable switch button means for displaying indicia on said display indicating times medicines were previously taken;

user operable switch button means for displaying indicia on said display indicating current alarm time and next alarm time; and a hinged cover on said second container moveable between an open position covering none of said plurality of user operable switch button means and a closed position wherein only one of said user operable switch button means remains exposed;

said one of said user operable switch buttons remaining exposed being incapable of changing the programming of said microprocessor without access to at least one additional user operable switch button means, thereby preventing accidental programming of said microprocessor when said cover is in said closed position.

2. The electronic medicine storage and reminder device according to claim 1 wherein said cavity lids and said light emitting means bear corresponding indicia.

3. The electronic medicine storage and reminder device according to claim 1 wherein said means for releasably securing said first and second containers together comprises a plurality of pegs on one of said first and second containers and corresponding holes on the other to engage and releasably hold said pegs.

4. The electronic medicine storage and reminder device according to claim 1 further including a pill splitter and means for releasably securing said pill splitter to one of said first and second containers.

5. The electronic medicine storage and reminder device according to claim 4 wherein said pill splitter comprises:

a base member having an internal opening;

a cover hingedly mounted on said base member and movable between positions covering said opening and away from said opening;

a shelf inside said opening; and a sharp blade mounted on said cover and movable therewith to approach said shelf when said cover is closed;

whereby a pill on said shelf will be split when said cover is closed.

6. The electronic medicine storage and reminder device according to claim 5 further including means on said shelf for positioning said pill centrally adjacent to said blade so that said pill will be split into substantially equal halves and a cavity adjacent to said shelf for receiving split pills.

7. A unitary, user operable, electronic medicine storage and reminder device, which comprises:

first and second containers;

means for releasably securing said first and second containers together comprising a plurality of pegs on one of said first and second containers and corresponding holes on the other to engage and releasably hold said pegs whereby different first and second containers may be interchanged;

a pill splitter comprising:

a base member having an internal opening;

a cover hingedly mounted on said base member and moveable between positions covering said opening and away from said opening;

a flap hingedly secured to said cover, said flap configured to close over a sidewall of said base, said flap including at least one upstanding peg sized to enter a corresponding hole in said sidewall and releasably secure said cover in a closed position whereby inadvertent opening of said pill splitter is prevented;

a shelf inside said opening; and a sharp blade mounted on said cover and movable therewith to approach said shelf when said cover is closed;

a cavity adjacent to said shelf for receiving split pills;

whereby a pill on said shelf will be split when said cover is closed and can enter said cavity;

said first container comprising:

a plurality of spaced compartments;

a lid for each said compartment; and latch means for releasably closing each said compartment;

said second container comprising:

an alarm signaling means comprising a light emitting means corresponding to each of said compartments and a sound emitting means;

display means for displaying indicia;

a microprocessor including:

user operable manual switch button means for setting correct time and for displaying said correct time on said display means;

user operable manual switch button means for setting alarm times for taking medicine from each said compartment, for displaying alarm times on said display means and for actuating said signaling means at said alarm times;

user operable manual switch button means for clearing all set alarm times;

user operable manual switch button means for displaying all set alarm times in seriatim;

user operable manual switch button means for displaying indicia on said display indicating that a time for taking a medicine has arrived and the time for taking the next medicine;

user operable manual switch button means for displaying indicia on said display indicating that a medicine has been taken when scheduled;

user operable manual switch button means for displaying indicia on said display indicating that a medicine has not been taken when scheduled;

user operable manual switch button means for displaying indicia on said display indicating times medicines were previously taken;

user operable manual switch button means for displaying indicia on said display indicating current alarm time and next alarm time; and a hinged cover attached to said second container said hinged cover having an open position exposing all of said user operable manual switch button means and having a closed position wherein only said switch button means for actuating said signaling means at said alarm times is exposed thereby preventing programming of said microprocessor when said cover is in said closed position.

8. A unitary, user operable, electronic medicine storage and reminder device, which comprises:

first and second containers;

means for releasably securing said first and second containers together;

said first container comprising:

a plurality of spaced compartments;

a lid for each said compartment; and latch means for releasably closing each said compartment;

said second container comprising:

an alarm signaling means comprising a light emitting means corresponding to each of said compartments and a sound emitting means;

display means for displaying indicia;

a microprocessor including:

at least two switch buttons for programming of operating instructions into said microprocessor said programming of operating instructions always requiring at least two of said switch buttons;

said operating instructions for said microprocessor including alarm times for activating said alarm signaling means;

a single of said switch buttons only being required to deactivate said alarm signaling means; and a cover hinged to said second container, said hinged cover having an open position exposing all of said switch buttons and a closed position wherein only said single of said switch buttons is exposed whereby programming said operating instructions into said microprocessor is prevented when said cover is in said closed position.

* * * * *